United States Patent [19]

Kinashi

[11] Patent Number: 4,947,473

[45] Date of Patent: Aug. 7, 1990

[54] DEVELOPING DEVICE FOR COPIER

[75] Inventor: Hiroshi Kinashi, Kyoto, Japan

[73] Assignee: Sharp Kabushiki Kaisha, Osaka, Japan

[21] Appl. No.: 193,501

[22] Filed: May 12, 1988

[30] Foreign Application Priority Data

May 28, 1987 [JP] Japan ..... 62-82563[U]

[51] Int. Cl.[5] ..... G03G 15/08; G03G 21/00

[52] U.S. Cl. ..... 355/259; 118/689

[58] Field of Search ..... 355/14 D; 118/689, 690, 118/691; 366/297, 298

[56] References Cited

U.S. PATENT DOCUMENTS 4,155,638 5/1979 Blitzer ..... 355/14 D
4,462,680 7/1984 Ikeda ..... 355/14 D
4,777,512 10/1988 Takahashi et al. ..... 355/14 D
4,785,331 11/1988 Oka et al. ..... 355/14 D
4,786,942 11/1988 Kusumoto et al. ..... 355/14 D X

*Primary Examiner*—Fred L. Braun
*Assistant Examiner*—Barry J. Shapiro
*Attorney, Agent, or Firm*—Flehr, Hohbach, Test, Albritton & Herbert

[57] ABSTRACT

A developing device for a copier is controlled such that if the rate at which toner is supplied into its developing tank is detected to exceed a preset reference value, stirring rollers for stirring the toner inside the developing tank are caused to rotate at a slower rate than if the toner supply rate is detected to be less than the reference value such that toner can be charged sufficiently in spite of its increased rate of supply and an image of good quality can be obtained.

3 Claims, 2 Drawing Sheets

DEVELOPING DEVICE FOR COPIER

BACKGROUND OF THE INVENTION

This invention relates to a developing device for a copier having a developing tank with rollers for stirring toner therein.

In a conventional developing device for a copier, stirring rollers rotate to stir toner and its carrier together such that the toner becomes charged by friction and the rate of the roller rotation is kept constant such that the toner becomes charged to a desired constant level. When the rate at which toner is supplied into such a conventional developing device exceeds a certain level, friction between the toner and the carrier becomes insufficient to charge the toner to the desired level as shown in FIG. 8 because the rollers rotate at a fixed rate. Toner particles which are not charged sufficiently to the desired level become attached to the photoreceptor of the copier and there arises the serious problem of toner becoming transferred to areas where such toner transfer is not intended with the result that the quality of the obtained pictorial image is adversely affected.

SUMMARY OF THE INVENTION

It is therefore an object of the present invention to provide an improved developing device for a copier with which toner can be charged sufficiently by friction with the carrier such that an image of good quality can be obtained even when a large amount of toner has been supplied.

A developing device of the present invention with which the above and other objects are achieved is characterized as being provided not only with a developing tank and stirring rollers but also with a detector for measuring the rate at which toner is being supplied from a supply tank into the developing tank and a control unit for controlling the rate of revolution of the stirring rollers. This control unit is adapted to transmit a "slow" signal to the driving units for the stirring rollers if the rate of toner supply from the supply tank is greater than a certain predetermined reference level according to the rate detector and a "fast" signal if the supply rate detector determines that the toner supply rate is less than that predetermined reference value. As the amount of toner inside the tank is reduced, a new supply of toner is delivered, for example, by rotating a supply roller. At such a moment, if the rate detector determines that the rate of toner supply exceeds the predetermined reference value, a "slow" signal is transmitted which causes the rate of revolution of the stirring rollers to decrease such that toner can become more effectively charged by friction with the carrier and an image of good quality can be obtained as desired.

BRIEF DESCRIPTION OF THE DRAWINGS

The accompanying drawings, which are incorporated in and form a part of the specification, illustrate an embodiment of the present invention and, together with the description, serve to explain the principles of the invention. In the drawings.

DETAILED DESCRIPTION OF THE INVENTION

Figure 1:
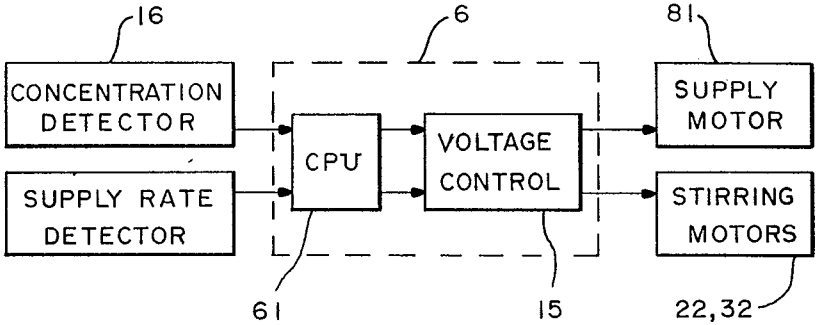
FIG. 1 is a block diagram of a control unit for a developing device embodying the present invention.
Figure 2:
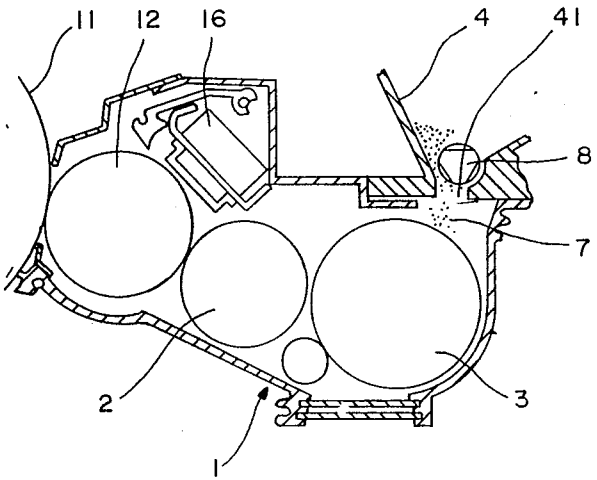
FIG. 2 is a sectional view of a developing device embodying the present invention.
Figure 3:
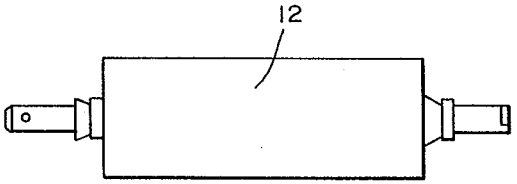
FIG. 3 is a plan view of the developing roller shown in FIG. 2.

A developing device embodying the present invention is comprised not only of a developing tank 1, a first stirring roller 3 and a second stirring roller 2 as shown in FIG. 2 but also of a supply rate detector 5 as shown in FIG. 1 for detecting the rate at which toner 7 is supplied from a toner supply tank 4 as well as a toner charge control unit 6 for controlling the rate of revolution of the stirring rollers 2 and 3. This toner charge control unit 6 is adapted to output a "slow" signal if the supply rate detector 5 outputs a signal indicating that toner 7 is being supplied faster than a predetermined reference value and a "fast" signal if the supply rate detector 5 outputs a signal indicating that the rate of toner supply from the supply tank 4 is slower than this reference value. The "slow" and "fast" signals are received by driving means 22 and 32 for the stirring rollers 2 and 3 which are accordingly rotated at a slower or faster rate in response to the received signal.

The supply tank 4 is affixed to an upper surface of the developing tank 1 and a toner supply roller 8 is disposed at an outlet opening 41 of the supply tank 4. In FIG. 1, numeral 81 indicates a driving unit (motor) for the toner supply roller 8 and the supply rate detector 5 includes a time detector (not shown) which calculates the duration of time during which a driving signal has been transmitted to this driving unit 81. In FIG. 2, numeral 11 indicates a photoreceptor (photosensitive drum) near which the developing tank 1 is disposed. Numeral 12 indicates a developer roller which rotates at a constant rate. The developing tank 1 contains the developer roller 12 and the stirring rollers 2 and 3 next to one another.

Figure 4:
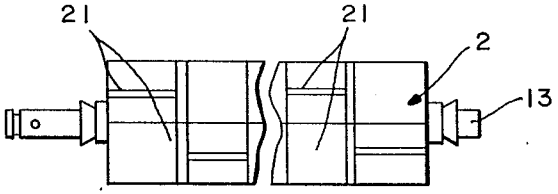
FIG. 4 is a plan view of the second stirring roller shown in FIG. 2.
Figure 5:
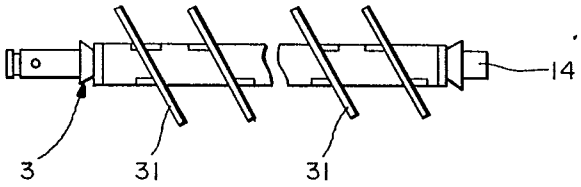
FIG. 5 is a plan view of the first stirring roller shown in FIG. 2.

As shown in FIGS. 4 and 5, the two stirring rollers 2 and 3 have differently shaped vanes respectively on their outer peripheral surfaces. The second stirring roller 2 disposed closer to the photoreceptor 11 as shown in FIG. 2 has a plurality of vanes 21 radially protruding from its axis of rotation 13. By contrast, the first stirring roller 3 distal from the photoreceptor 11 has a plurality of vanes 31 disposed obliquely with respect to its axis of rotation 14.

The toner charge control unit 6 is formed as an ordinary one-chip microcomputer and includes as shown in FIG. 1 a central processing unit (CPU) 61 and a voltage control circuit 15. The control unit 6 is connected on the one hand to a toner concentration detector 16 disposed above the developer roller 12 as well as the aforementioned time detector as a part of the supply rate detector 5, both these detectors 5 and 16 serving to transmit signals to the control unit 6, and on the other hand not only to the driving unit 81 for the toner supply roller 8 but also to the driving units 22 and 32 respectively for the two toner stirring rollers 2 and 3, these various driving units 81, 22 and 32 serving to receive signals transmitted from the control unit 6. The aforementioned microcomputer may be programmed to serve as the aforementioned time detector.

Among the functions served by the control unit 6 are that of transmitting to the supply roller driving unit 81 a driving signal when a signal indicative of insufficient toner concentration is received from the toner concentration detector 16, that of making a comparison between the time indicated by a signal received from the time detector and a preset reference time value and that of transmitting a "fast" signal or a "slow" signal to the stirring roller driving units 22 and 32 to control the rate of revolution of the stirring rollers 2 and 3, depending on the result of the aforementioned comparison. Thus, the control unit 6 serves to keep track of the time during which the toner supply roller 8 has been rotating, to compare this measured time with a preset reference time value and, if the measured time is judged to have exceeded this preset reference time value, to conclude that enough toner 7 has been supplied, thereupon transmitting a "slow" signal to the stirring roller driving units 22 and 32 such that the toner 7 becomes mixed well with its carrier. If the measured time is judged not to have reached the reference time value, on the other hand, the control unit 6 concludes that the rate of toner supply is low or normal and transmits a "fast" signal to the stirring roller driving units 22 and 32.

Figure 7:
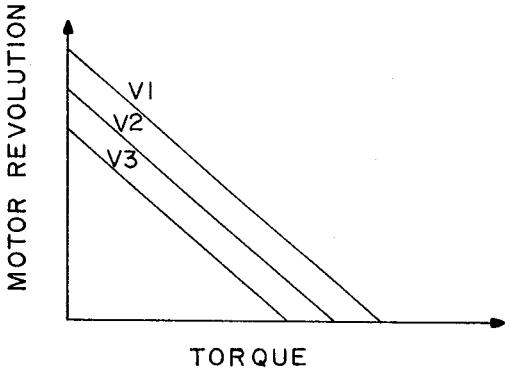
FIG. 7 is a graph schematically showing the effects of voltage applied to the motor for the stirring rollers on the relationship between the torque of the motor and the rate of its revolution.
Figure 8:
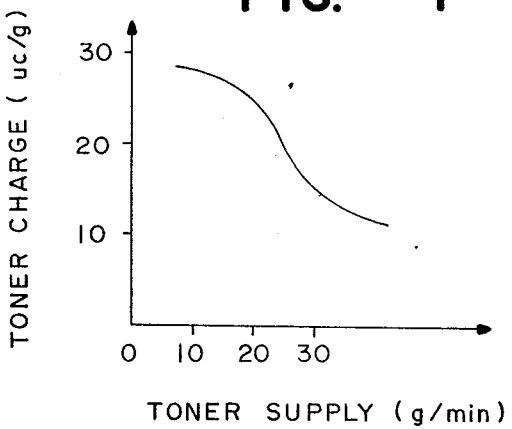
FIG. 8 is a graph schematically showing the relationship between the rate of toner supply and the toner charge when the rate of revolution of the stirring rollers is fixed.
Figure 6:
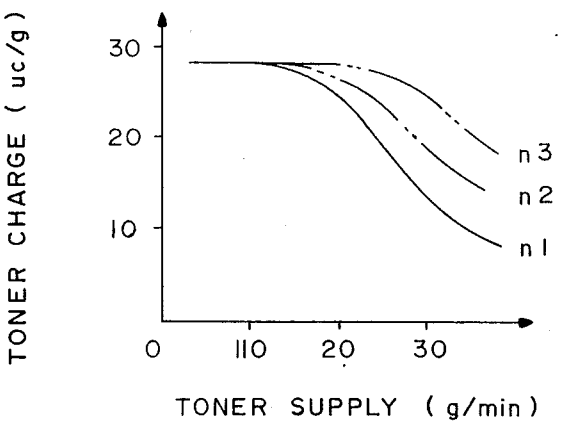
FIG. 6 is a graph schematically showing the effects of the rate of revolution of the stirring rollers on the relationship between the rate of toner supply and the toner charge.

FIG. 7 shows the torque-revolution characteristics of a DC motor for driving the stirring rollers 2 and 3 as the voltage applied to it is varied ($V_1 > V_2 > V_3$). FIG. 8 shows the relationship between the supply rate of toner from the supply tank 4 and the toner charge. From FIG. 8, it is clearly understandable that the toner charge drops as the rate of toner supply increases if the rate of revolution of the stirring rollers 2 and 3 is kept constant. FIG. 6 shows the relationship between the rate of toner supply and the toner charge as the rate of revolution of the toner stirring rollers 2 and 3 is changed. It is clear from FIG. 6 that the drop in the toner charge as the rate of toner supply is increased as shown in FIG. 8 is reduced if the rate of revolution n of the stirring rollers 2 and 3 is reduced ($n_1 > n_2 > n_3$). According to one embodiment of the present invention, the rate of revolution of the stirring rollers 2 and 3 is controlled in two steps. The operation of the developing device is summarized next. After the toner 7 is supplied from the toner supply tank 4 into the developing tank 1 by the rotation of the toner supply roller 8, it becomes mixed with the carrier by the operation of the toner stirring rollers 2 and 3 and transported to the developer roller 12 which serves to form a magnetic toner brush to effect a development operation. The toner concentration near the developer roller 12 is measured by the toner concentration detector 16 and if the measured toner concentration drops, a signal indicative thereof is transmitted to the control unit 6 which responds by transmitting a start signal to the driving unit 81 for the toner supply roller 8. At the same time, the supply rate detector 5 (time detector) outputs a time signal indicative of the time of revolution of the drive unit 81 for the toner supply roller 8. When this time of revolution exceeds a preset reference value, the control unit 6 transmits a "slow" signal to the driving units 22 and 32 of the stirring rollers 2 and 3. As the rate of revolution of the stirring rollers 2 and 3 is reduced in response to this "slow" signal, the toner 7 supplied into the developing tank 1 is stirred sufficiently effectively with the carrier as shown in FIG. 6 although the rate of toner supply has been increased. As a result, the toner 7 becomes sufficiently charged as it reaches the developer roller 12 even if the toner supply roller rotates for a long time and the toner supply rate increases, and an image of good quality can be obtained without transfer of toner into areas where such transfer is not desired. When the toner concentration detector 16 detects the toner concentration to be sufficiently high and transmits a signal indicative thereof, the control unit responds by transmitting a stop signal, thereby stopping further supply of toner.

The foregoing description of a preferred embodiment of the invention has been presented for purposes of illustration and description. It is not intended to be exhaustive or to limit the invention to the precise form disclosed, and many modifications and variations are possible in light of the above teaching. For example, the supply rate detector 5 need not consist solely of a time detector for measuring the length of time during which the control unit 6 transmits a drive signal. The rate of toner supply may be measured entirely by the toner concentration detector 16 or by an optical detector adapted to measure the amount of toner dropped from the outlet opening 41 of the toner supply tank 4. In other words, what was referred to above as the supply rate detector 5 has only to be able to measure the rate of toner supply. As another example, the rate of revolution of the stirring rollers 2 and 3 may be adapted to be controlled in three or more steps or even continuously. The rate of revolution itself need not be controlled by changing the output voltage of a motor. A mechanical means for changing speed may be utilized. Any modifications and variations that may be apparent to a person skilled in the art are intended to be included within the scope of this invention.

What is claimed is:

1. A developing device for a copier comprising a developing tank containing stirring rollers for stirring toner therein, a supply rate detecting means for detecting the rate of toner supply into said developing tank, and a control unit for controlling the rate of revolution of said stirring rollers, said control unit causing said stirring rollers to rotate at a slower rate if said supply rate detecting means detects the rate of toner supply into said developing tank to be greater than a preset value and at a faster rate if said supply rate detecting means detects the rate of toner supply into said developing tank to be less than said preset value.

2. The developing device of claim 1 further comprising a toner supply roller which serves to supply toner from a toner supply tank into said developing tank by rotating.

3. The developing device of claim 2 wherein said supply rate detecting means includes a time detector for measuring the time during which control unit transmits a drive signal which causes said toner supply roller to rotate.

* * * * *